United States Patent [19]

Muratov et al.

[11] 4,137,745

[45] Feb. 6, 1979

[54] DEVICE FOR EXTRUDING HOLLOW ARTICLES

[76] Inventors: Rustem I. Muratov, ulitsa Vyazemskaya, 1/143, kv. 55; Jury D. Kot, ulitsa Boitsovaya, 24, korpus 3, kv. 35; Mikhail F. Belov, Partizanskaya ulitsa, 47, kv. 26; Melis S. Gildengorn, Orshanskaya ulitsa, 4, kv. 44; Vyacheslav S. Konkov, ulitsa Nedelina, 8, kv. 18; Mikhail I. Erlikh, ulitsa Tolbukhina, 9, korpus 1, kv. 69, all of Moscow, U.S.S.R.

[21] Appl. No.: 664,266

[22] Filed: Mar. 5, 1976

[51] Int. Cl.[2] ..... B21C 23/04; B21C 25/02; B21D 37/04

[52] U.S. Cl. ..... 72/263; 72/264; 72/467; 72/481; 425/466

[58] Field of Search ..... 72/253, 264, 265, 467, 72/468, 481, 268, 263; 207/17.4, 18; 425/466

[56] References Cited

U.S. PATENT DOCUMENTS

| | | | |
|---|---|---|---|
| 558,257 | 4/1896 | Cobb | 72/268 |
| 1,100,002 | 6/1914 | Van Ness | 72/268 |
| 1,185,302 | 5/1916 | Garretson | 72/467 |
| 1,984,775 | 12/1934 | Swartz | 72/268 |
| 2,805,446 | 9/1957 | Bartoo | 425/466 |

FOREIGN PATENT DOCUMENTS

| | | | |
|---|---|---|---|
| 1380420 | 10/1964 | France | 72/264 |

*Primary Examiner*—C. W. Lanham
*Assistant Examiner*—D. M. Gurley
*Attorney, Agent, or Firm*—Lackenbach, Lilling & Siegel

[57] ABSTRACT

In a device for extruding hollow articles, e.g. tubes, the die is rotatably mounted in the die holder. The die has a hole for shaping the external surface of the tube. The axis of said hole is eccentric relative to the axis of the external surface of the die holder. The device comprises a needle for shaping the internal surface of the tube, the needle entering the die hole during the process of extrusion. The needle axis coincides with the extrusion axis. The die holder is made of at least two bushings, installed one inside the other. The axes of the internal surfaces of the bushings are offset relative to the axes of their external surfaces. The bushings are capable of turning for adjusting the position of the die hole axis relative to the needle. This design of the die holder makes it possible to minimize the eccentricity of the axes of the internal and external surfaces of the tubes extruded in the device realized according to the present invention and installed in a conventional press.

2 Claims, 3 Drawing Figures

DEVICE FOR EXTRUDING HOLLOW ARTICLES

The present invention relates to the field of metal-working and more particularly it relates to a device for extruding hollow articles.

The device accomplished in accordance with the present invention can be used to advantage for extruding tubes with minimum wall variations. Those skilled in the art know that the term "wall variations" denotes the eccentricity between the axes of the internal and external surfaces of the tube.

The device for extruding hollow articles according to the present invention can be utilized in presses of conventional designs.

Known in the prior art is a device for extruding hollow articles, e.g. tubes, wherein the die is set in such a manner that its geometrical axis coincides with that of the die holder which, in turn, is set coaxially with the container bushing, the needle, the punch and the dummy block and is located in the head of the press neck. All the above-mentioned elements are arranged along one and the same axis which serves as the axis of extrusion.

In the overwhelming majority of cases the above-mentioned devices cannot be used for extrusion of tubing with smaller tolerances of wall variations than those stipulated in the standing national standards due to the effect of various technological factors, such as the influence of upsetting, the wall variations of billets, and obliquity (out-of-squareness of the billet ends to their longitudinal axes).

Besides, the known devices cannot ensure extrusion of tubes with minimum wall variations owing to the fact that wear of the tool disturbs the preset relative arrangement of all the moving parts of the press.

Today, the rapid development of certain industries, e.g. aircraft and rocket building industries which are the main consumers of extruded aluminium-alloy tubes, has created the need for reducing the wall variations to a minimum since this decreases considerably the weight of an aircraft or a rocket. This becomes increasingly important because the methods of cold working employed after extrusion are not effective in eliminating the wall variations.

Therefore, the tubes with minimum wall variations are presently manufactured on precision presses whose units are accurately aligned and stiff, thus raising the manufacturing cost of said presses. Periodical alignment of these presses necessitated by wear of their units calls for heavy expenditures of labor and funds.

On the other hand, the vast majority of technological flow charts for the extrusion of tubing require that the axis of the die hole should be moved relative to the extrusion axis over a preset distance to make up for the bending of the needle in the course of extrusion.

However, such movement of the needle is not ensured by the conventional design of the press.

Another known device for extruding hollow articles comprises a die rotatably mounted in a die holder. The external surface of the hollow article is formed by the die hole whose geometrical axis is eccentric relative to the geometrical axis of the external surface of the die. The internal surface of the hollow article is shaped by a needle which enters the die hole in the course of extrusion. The die holder is an integral part whose geometrical axis is aligned with the extrusion axis.

The basic disadvantage of the known design consists in that the displacement of the geometrical axis of the die hole relative to that of the external surface of the die is constant and the geometrical axis of the die hole is deliberately offset from the extrusion axis by the value of eccentricity and cannot be changed for adjusting the position of the geometrical axis of the die hole relative to the geometrical axis of the needle.

The main object of the invention is to provide a device for extruding hollow articles wherein the design of the die holder would permit adjustment of the position of the geometrical axis of the die hole relative to the needle axis within a wide range with sufficient accuracy and in a comparatively short time.

This object is accomplished by providing a device for extruding a hollow article wherein a die is rotatably mounted in a die holder and has a hole for forming the external surface of a hollow article, the geometrical axis of said hole being eccentric relative to the geometrical axis of the external surface of the die holder. The needle intended for shaping the internal surface of the hollow article enters the die hole in the course of extrusion. According to the invention, the die holder is made of two bushings one of which is rotatably installed in the other, the geometrical axes of the internal surface of said bushings being offset relative to the geometrical axes of their external surfaces.

Such a device for extruding a hollow article permits adjustment of the position of the geometrical axis of the die hole relative to the needle axis which, in turn, permits manufacturing of a hollow article (tube) with minimum wall variations.

In addition, such a device is comparatively simple and economical to manufacture, and is also of sufficient reliability in operation.

The device for extruding a hollow article according to the present invention is easy to operate and its operator can accurately adjust the position of the geometrical axis of the die hole relative to the needle axis by the use of simple instruments and appliances.

Other characteristics and advantages of the invention will become apparent from the detailed description of its embodiment that follows, and from the accompanying drawings, in which.

Figure 1:
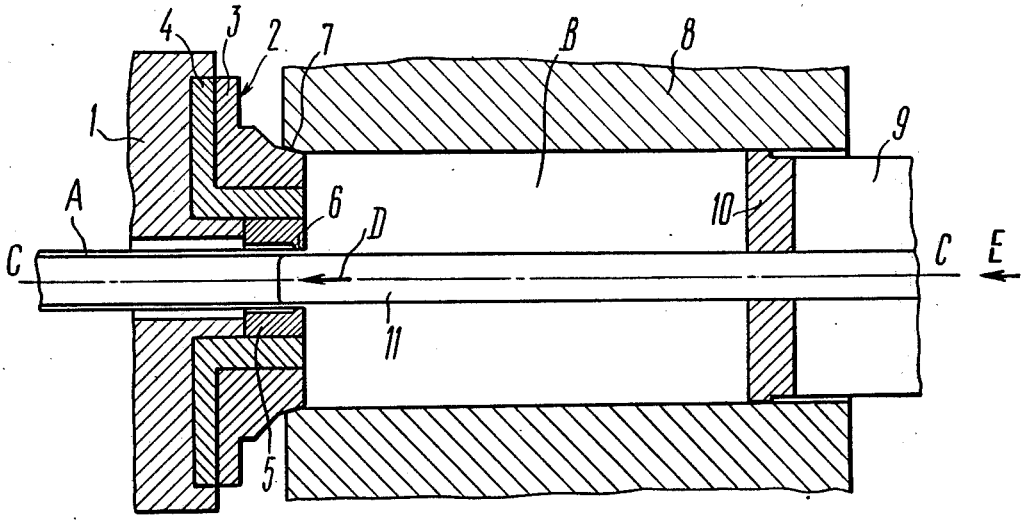
FIG. 1 is a longitudinal sectional view of the device for extruding a hollow article according to the invention.

The device according to the present invention is mounted on a support 1 (FIG. 1) which is constituted in the given embodiment of the invention by the head of the outer die (not shown in the drawing).

Figure 2:
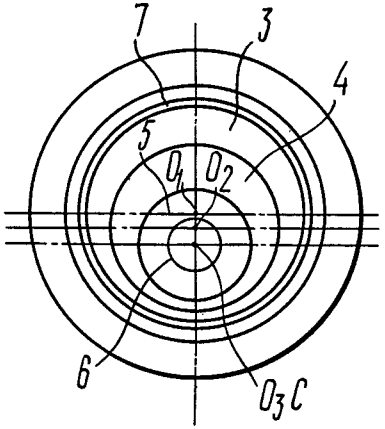
FIG. 2 is an end view of the device taken along or in the direction of arrow D with the needle removed.

Mounted on the support 1 is a die holder 2 which in our example consists of two bushings 3 and 4 (outer and inner, respectively). The geometrical axes $O_2$, $O_3$ (FIG. 2) of the internal surfaces of the bushings 3 and 4, respectively, are offset from the geometrical axes $O_1$, $O_2$ of their external surfaces. The geometrical axis $O_2$ of the internal surface of the bushing 3 coincides with the geometrical axis of the external surface of the bushing 4. The bushings 3, 4 are installed one in the other and can rotate either together or relative to each other.

The die 5 (FIG. 1) mounted in the die holder 2 has a hole 6 intended for shaping the external surface of the tube. The geometrical axis $O_3$ (FIG. 2) of the hole 6 is arranged with eccentricity $\epsilon$ relative to the geometrical axis $O_1$ of the external surface of the die holder. $O_3$ serves also as the geometrical axis of the internal surface of the bushing 4 of the die holder 2. The die 5 is mounted with a provision for rotating either together with the bushings 3 and 4 or with either one of them at the operator's will.

The die holder 2 is provided with a tapered collar 7 (FIG. 1) located on the external surface of the bushing 3 and 4 fitting tightly against the bushing 8 of the container (not shown in the drawing). As the tube A is extruded from the billet B (either hollow or solid), the container receives a punch 9 carrying a dummy block 10 and a needle 11. The geometrical axes of the punch 9, the dummy block 10 and the needle 11 coincide with the extrusion axis C—C.

The needle 11 can be rigidly fixed on the punch 9 when the tubes are extruded on presses without a piercing system, or it can be secured in a needle holder of the piercing system in the presses provided with such system.

Those skilled in the art know that the piercing system ensures piercing of a solid billet with the needle, or the passage of the needle through a billet when tubes are extruded from hollow billets.

The needle serves to shape the internal surface of the tube A when it is located in the hole 6 of the die 5 in the course of extrusion. This layout of the device provides for a sufficiently accurate adjustment of the position of the geometrical axis $O_3$ of the hole 6 of the die 5 relative to the geometrical axis C—C of the needle 11.

The device realized according to the present invention functions as follows.

Before the beginning of extrusion the die holder 2 with the die 5 comes in contact by its tapered collar 7 with the bushing 8 of the container (not shown in the drawing).

The bushings 3 and 4 of the die holder 2 are turned in such a way that the geometrical axis $O_3$ of the hole 6 of the die 5 is in line with the geometrical axis $O_1$ of the external surface of the die holder, and, correspondingly, with the extrusion axis C—C. The container bushing 8 is fed with a solid billet B for extrusion with piercing or a hollow billet for extrusion without piercing. The punch 9 and the needle 11 move in the direction shown by arrow E in FIG. 1, position the needle 11 in the hole 6 of the die 5 and upset the billet B under pressure in order to take up the clearance between the billet B and the container bushing 8. Then the tube is extruded.

As the tube A emerges from the hole 6 of the die 5 and after completion of one extruding cycle, i.e. extrusion of one billet, the operator measures the thickness of the tube walls and determines the degree and direction of axial misalignment of the needle 11 relative to the die 5.

By turning the bushings 3 and 4 of the die holder 2 through the prescribed angles, the operator moves the geometrical axis $O_3$ of the hole 6 of the die 5 relative to the geometrical axis C—C of the needle 11 in the required direction and over the preset distance thus eliminating the effect of the factors causing wall variations of the tube being extruded, e.g. the effect of upsetting, wall variations of the billet and its obliquity.

Then a new billet is fed into the container bushing 8 and the next tube is extruded.

The position of the axis $O_3$ of the die hole 6 relative to the axis C—C of the needle 11 is adjusted as follows.

Figure 3:
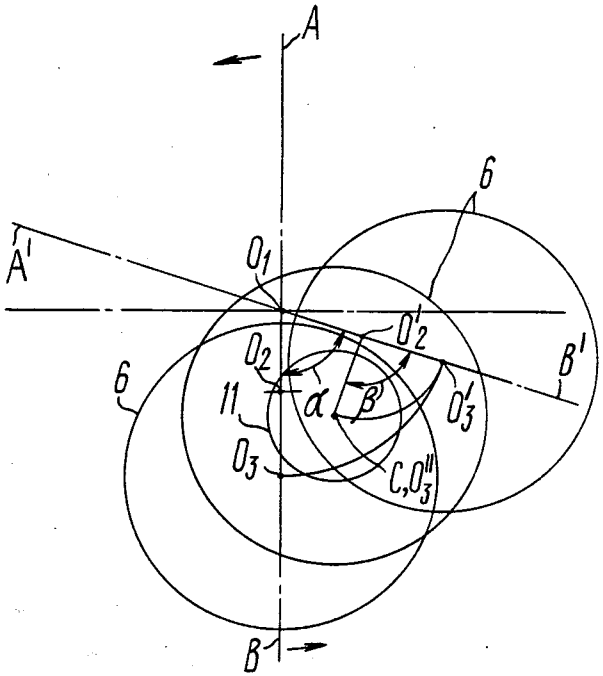
FIG. 3 is a diagram showing the adjustment of the position of the geometrical axis of the die hole relative to the needle axis by turning the die holder bushings.

FIG. 3 shows the geometrical axis $O_1$ of the external surface of the bushing 3, the geometrical axis $O_2$ of the internal surface of the bushing 3 and of the external surface of the bushing 4, and the geometrical axis $O_3$ of the internal surface of the bushing 4 and of the die 5. The die 5 as well as the bushings 3, 4 are not shown in FIG. 3 for convenience.

On turning the bushing 3 relative to axis $O_1$ through angle $\alpha$, the axes $O_2$ and $O_3$ also move through angle $\alpha$ and occupy positions $O_2'$ and $O_3'$, respectively. Then, by turning the bushing 4 through angle $\beta$ relative to axis $O_2'$, the geometrical axis $O_3'$ is set to the required position $O_3''$ which coincides with the position of the axis C—C of the needle 11, i.e. of the extrusion axis; this ensures minimum wall variations of the tubes.

The device realized according to the present invention can be employed effectively in order to reduce the wall variations of the extruded tubing within a single extrusion cycle, i.e. while extruding one tube.

For this purpose it is possible to install any suitable measuring gauge (not shown) at the outlet from the hole 6 of the die 5 for the purpose of determining the wall thickness of the tube being extruded and sending a signal to an actuating mechanism (not shown) which may also be of any suitable construction. Said actuating mechanism will rotate the bushings 3 and 4 together with the die by means of a mechanical, hydraulic or pneumatic transmission, thus moving the hole 6 of the die 5 relative to the axis of the needle 11 and of the container bushing 8. This ensures minimum wall variations of the extruded tube.

The use of the device according to the invention has made it possible to reduce the wall variation tolerances of the extruded tubes in half as compared with the existing tolerances and thus to raise the metal utilization factor.

Besides, it is now possible to extrude tubes with wall variations not exceeding 3%.

An experimental model of the device for extruding hollow articles realized according to the present invention is effectively and continuously operating in the fabrication of tubes by extrusion.

The device for extruding hollow articles is simple to manufacture, convenient and safe in operation and permits adjustment of the positions of the die and needle axes by means of simple instruments and appliances.

The device for extruding hollow articles according to the present invention can be used in conjunction with conventional presses for fabrication of tubes.

We claim:

1. A device for extruding hollow articles comprising a support; a die holder mounted on said support; a die mounted rotatably in said die holder and having a hole for shaping the external surface of the hollow article, a geometrical axis of said hole of said die being eccentric relative to the geometrical axis of the external surface of said die holder; a needle for shaping the internal surface of the hollow article entering the hole of said die in the course of extrusion; the improvement comprising said die holder being made of an inner bushing and at least one additional bushing with the geometrical axes of the internal surface of said bushings being offset relative to each other and to the geometrical axes of their external surfaces, and one of said bushings being installed in the other so that said bushings can be turned for adjusting the postion of the geometrical axis of said hole of said die relative to the axis of said needle, whereby said die can be positioned either together with rotation of said bushings or with rotation of either one of said bushings so as to ensure minimum wall variations of said hollow articles.

2. A device as defined in claim 1, wherein said bushings are provided with means for selectively rotating the same relative to each other, said means being accessible to permit adjustment by an operator of the extruding device at will.

* * * * *